United States Patent [19]

Gibbons

[11] Patent Number: 4,519,817

[45] Date of Patent: May 28, 1985

[54] PRECIPITATOR RAPPER

[75] Inventor: Robert E. Gibbons, Rockaway, N.J.

[73] Assignee: Belco Pollution Control Corporation, Parsippany, N.J.

[21] Appl. No.: 488,507

[22] Filed: Apr. 22, 1983

[51] Int. Cl.[3] ..... B03C 3/76

[52] U.S. Cl. ..... 55/112; 55/300; 173/99; 173/100; 173/124

[58] Field of Search ..... 55/112, 300, 304; 173/94, 99, 98, 96, 95, 90, 100, 115, 124

[56] References Cited

U.S. PATENT DOCUMENTS

| | | | |
|---|---|---|---|
| 665,364 | 1/1901 | Engstrom | 173/100 X |
| 1,162,871 | 12/1915 | Morris | 173/100 |
| 2,867,204 | 1/1959 | Arvay | 173/100 X |
| 4,093,431 | 6/1978 | Frauenfelder | 55/112 |

FOREIGN PATENT DOCUMENTS

| | | | |
|---|---|---|---|
| 235217 | 12/1963 | Austria | 173/124 |
| 505794 | 8/1930 | Fed. Rep. of Germany | 55/112 |
| WO80/02118 | 10/1980 | PCT Int'l Appl. | 55/112 |

*Primary Examiner*—Kathleen J. Prunner

*Attorney, Agent, or Firm*—Marvin A. Naigur; John E. Wilson; Thomas L. Adams

[57] ABSTRACT

A rapper for striking a target in a precipitator includes a hammer having a hub pivotally attached to a frame. The rapper also has a drive sprocket rotatably mounted in the frame. The sprocket has a driving plurality of spaced teeth distributed on the sprocket along a given peripheral sector. The latter cover less than the entire periphery of the sprocket. The teeth of the sprocket are distributed to mesh with and then release spokes on the hub of the hammer.

9 Claims, 10 Drawing Figures

PRECIPITATOR RAPPER

BACKGROUND OF INVENTION

The present invention relates to rappers for precipitators and, in particular, to reciprocatable hammers which may be mechanically driven to strike a target in the precipitator.

Electrostatic precipitators operate with an intense electrostatic field which ionizes exhaust gas to cause precipitation of particulate contaminants onto electrode plates in the precipitator. Since these contaminants adhere to the plates, they must be periodically cleaned to prevent clogging of the precipitator. A known technique for cleaning the plates is to strike a member supporting the precipitator plates so they vibrate and dislodge the precipitate thereupon. An inherent problem with such mechanisms is that any mechanical structure, especially gears and bearings, contained within the precipitator tends to become clogged itself with the precipitate. Another important design consideration for rappers is making their frequency and the magnitude of their impact variable. Such variation can be tailored to suit an unusually clean or dirty exhaust.

It is known to employ in a precipitator a rotating shaft carrying at least one hammer pivotally mounted off from the center of rotation of the shaft. The hammer, which can rotate only fractionally, is mounted within the precipitator adjacent to an anvil. Rotation of the shaft raises and inverts the hammer, after which it freely swings downwardly to strike the anvil.

Another known rapper has a reciprocatable lifter rotatably mounted at a different axis of rotation than a drive lever. The drive lever can employ a catch which engages and drives the lifter a predetermined amount before releasing it. A disadvantage with this type of apparatus is the large number of relatively moving parts and the high tolerances acquired to cause accurate operation and release of the rapper mechanism.

There are many known ways of mounting a rapper within a precipitator. Examples of the various rappers and other apparatus for dislodging dust, as well as their methods of mounting, are illustrated in U.S. Pat. Nos. 1,433,266; 1,551,724; 1,773,876; 2,547,573; and 4,221,573. In U.S. Pat. No. 1,433,266 a cam can reciprocate a frame to periodically lower it and knock it against a stationary member, thereby vibrating the precipitator structure and cleaning its plates. U.S. Pat. Nos. 1,551,724; 1,773,876 and 2,547,573 show various cams and mechanical structures used to clean a precipitator structure. U.S. Pat. No. 4,221,573 shows a pulley-type arrangement where an arcuate member rotates through a given angle before being released to drop a suspended weight against a structural member in a precipitator. Other known apparatus use electromechanical or air operated vibrators to accomplish the dislodging of dust adhering within a precipitator or dust collecting apparatus (eg. U.S. Pat. Nos. 333,021; 1,168,543; 2,550,809; and 2,702,090). U.S. Pat. Nos. 3,219,130 and 3,570,217 show the rotating of articulating hammers. These hammers, when rotated beyond a certain point, fall and swing faster than its driving shaft before impacting an anvil to create the vibration required to dislodge adhering dust.

Accordingly, there is a need for a simple and reliable rapper mechanism which can work in the dirty environment of a precipitator and yet be adjustable in frequency and impact magnitude.

SUMMARY OF THE INVENTION

In accordance with the illustrative embodiments demonstrating features and advantages of the present invention, there is provided a rapper for striking a target in a precipitator. The rapper has a frame, a hammer and a drive sprocket. The hammer has a hub pivotally attached to the frame. The drive sprocket is rotatably mounted in the frame and has a driving plurality of spaced teeth distributed on the sprocket along a given peripheral sector. The given peripheral sector is less than the entire periphery of the sprocket. The teeth of the sprocket are distributed to mesh with and then release spokes on the hub of the hammer.

By employing apparatus of the foregoing type, a highly reliable rapper mechanism can be provided. In a preferred embodiment the rapper mechanism is a pivotally suspended hammer mounted in a frame within the precipitator. This hammer has at its pivoted end, a plurality of radially disposed round spokes with rounded tips. The hammer meshes with teeth on a drive shaft. The teeth of the drive shaft are preferably round rods mounted parallel to the axis of the drive shaft on a pair of spaced circumferential ridges. Accordingly, the teeth of the drive shaft have clearance on all sides. Due to this clearance and the shape of the teeth on the hammer, there is little likelihood of clogging by precipitate.

In this preferred embodiment, the device has journals that tolerate warping of the drive shaft, a likely occurrence in the high temperature environment of a precipitator. In this preferred embodiment, the drive shaft extends through a vertical slot in the frame which allows the shaft a vertical degree of freedom. Also, the frame itself is mounted to allow it a horizontal degree of freedom. Thus, this drive shaft can wobble without binding—at least to a limited extent. Preferably, the axis of rotation of the hammer can be horizontally adjusted to set the degree of meshing between the drive shaft and hammer. Furthermore, the number of teeth on the drive shaft or on the driven end of the hammer can be changed to alter the extent to which the hammer is lifted by the drive shaft. Also, the speed of rotation of the driven shaft can be altered to effect the repetition rate of the hammer.

In this preferred embodiment, both the driving shaft and the hammer have teeth covering only a fraction of their periphery. The teeth lift the hammer to an upward position before releasing it. The following free fall of the hammer is unimpeded by any teeth, to deliver an impact accurately fixed by the height fallen. Furthermore, the last one of the teeth on the driven end of the hammer is the longest tooth and is also spaced further from its neighbors than is the case with the other teeth to ensure complete clearance of the teeth when the hammer is released.

DETAILED DESCRIPTION OF THE PREFERRED EMBODIMENT

Figure 1:
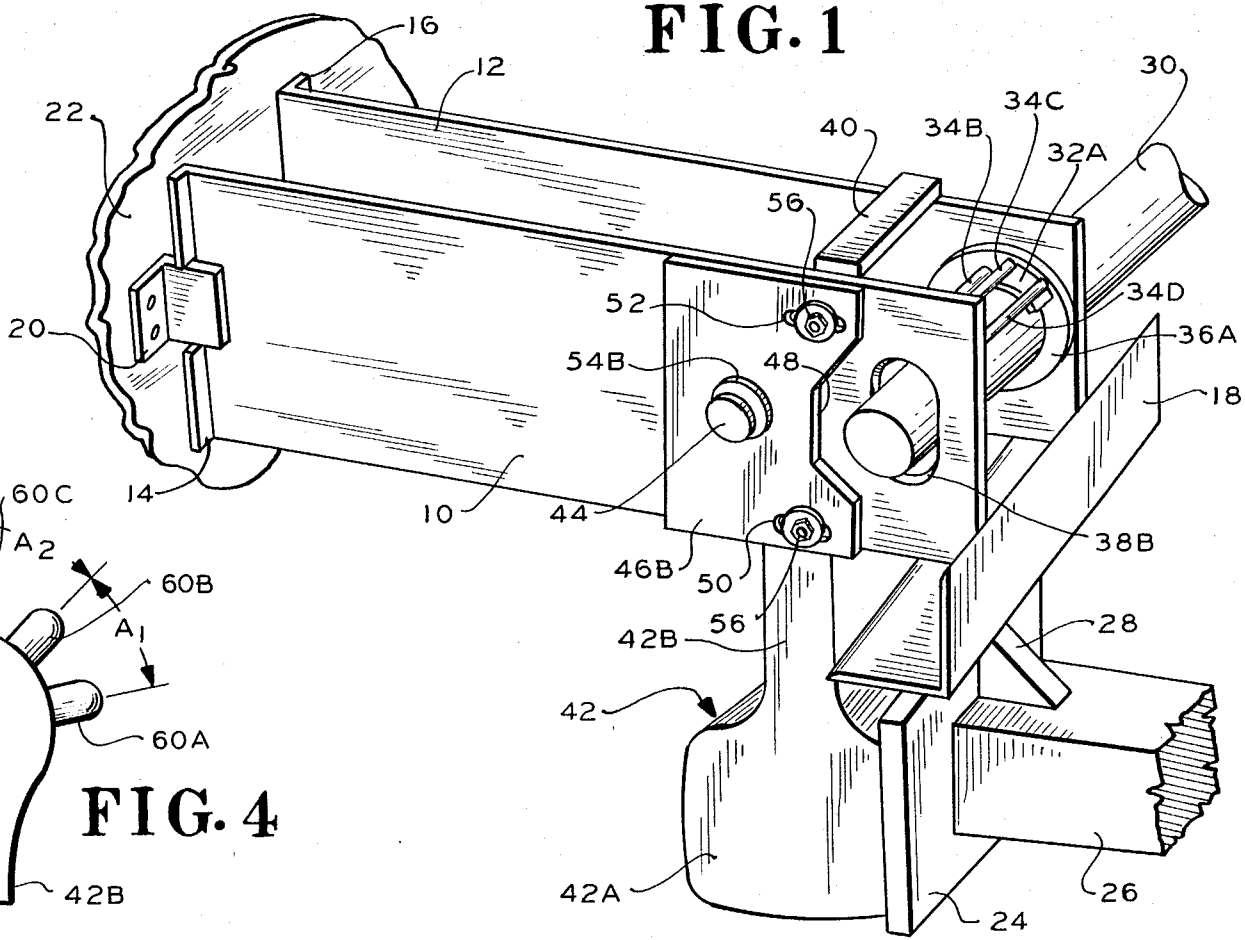
FIG. 1 is a perspective view of a rapper according to the principles of the present invention.
Figure 2:
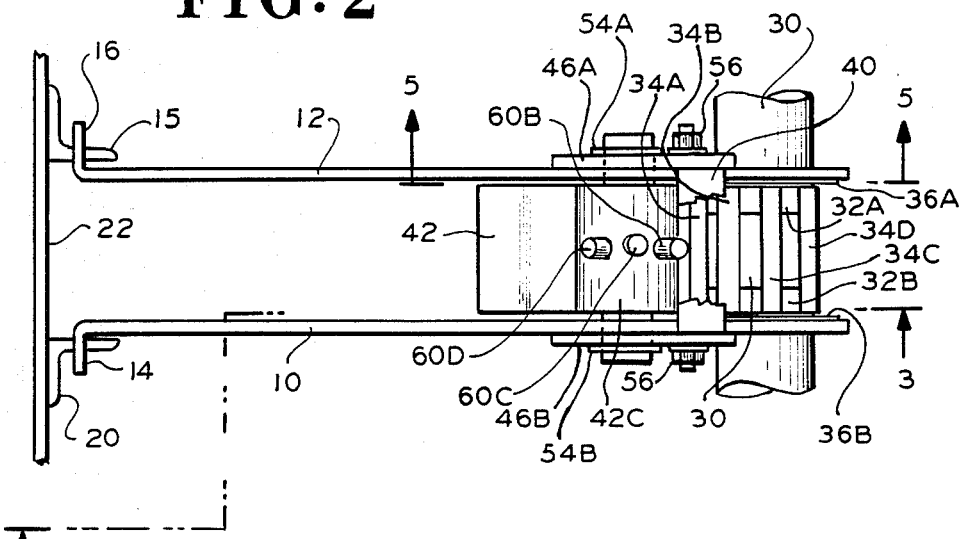
FIG. 2 is a plan view of the rapper of FIG. 1.

Referring to FIGS. 1 and 2, the illustrated rapper includes a frame comprising parallel beams 10 and 12 horizontally mounted and each having, at adjacent ends, outwardly extending flanges 14 and 16, respectively. The unflanged ends of beams 10 and 12 rest in angle bracket 18, which is part of the internal structure of an electrostatic precipitator. Flanges 14 and 16 have central notches into which angled tabs 20 and 15, respectively, are slidably inserted. Tabs 15 and 20 are fixed to vertical panel 22, which is also part of the internal structure of the electrostatic precipitator. Welded atop beams 10 and 12 is spanning brace 40. A striking target in the electrostatic precipitator, shown herein as striking plate 24, is vertically supported by horizontal beam 26, there being a wedge-shaped brace 28 welded between beam 26 and striking plate 24.

The illustrated drive sprocket has a drive shaft 30 onto which is welded a spaced pair of C-shaped strips 32A and 32B at a position between beams 12 and 10. A driving plurality of spaced teeth is formed by welding four parallel, axially disposed, rod-shaped teeth 34A, 34B, 34C and 34D to a peripheral sector across ridge-forming strips 32A and 32B. Significantly, there is central clearance at the underside of teeth 34A, 34B, 3C and 34D. This clearance, as will become clearer hereinafter, prevents jamming due to a clogging by precipitate. Spacers 36A and 36B are located around shaft 30 on the outboard side of strips 32A and 32B, respectively, to prevent teeth 34A, 34B, 34C and 34D from jamming into the elongated apertures surrounding shaft 30, such as elongate aperture 38B.

Hammer 42 is shown herein having an enlarged, weighted, free end 42A and a shank 42B leading to hub 42C. Hammer 42 is essentially made of flat metal stock which is narrowed along shank portion 42B and rounded at hub 42C. Hub 42C has an oversized bore for receiving shaft 44 which is journalled on opposite ends to bearing plates 46A and 46B. Bearing plates 46A and 46B are essentially rectangular plates on the outside of beams 12 and 10, respectively. Each plate has a notch 48 and a vertically spaced pair of horizontally disposed slots 50 and 52. Shaft 44 has welded near each of its ends a washer 54A and 54B on the outboard side of bearing plates 46A and 46B, respectively, to keep shaft 44 between the bearing plates. Plates 46A and 46B are each bolted to beams 12 and 10, respectively, by two nut, bolt and washer assemblies 56 through slots 50 and 52.

Figure 4:
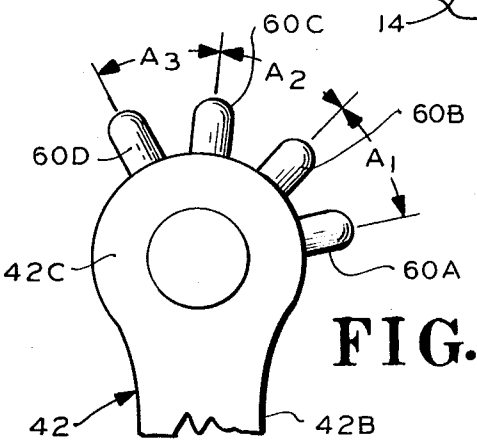
FIG. 4 is a detailed side view of the driven end of the hammer of FIG. 1.
Figure 3:
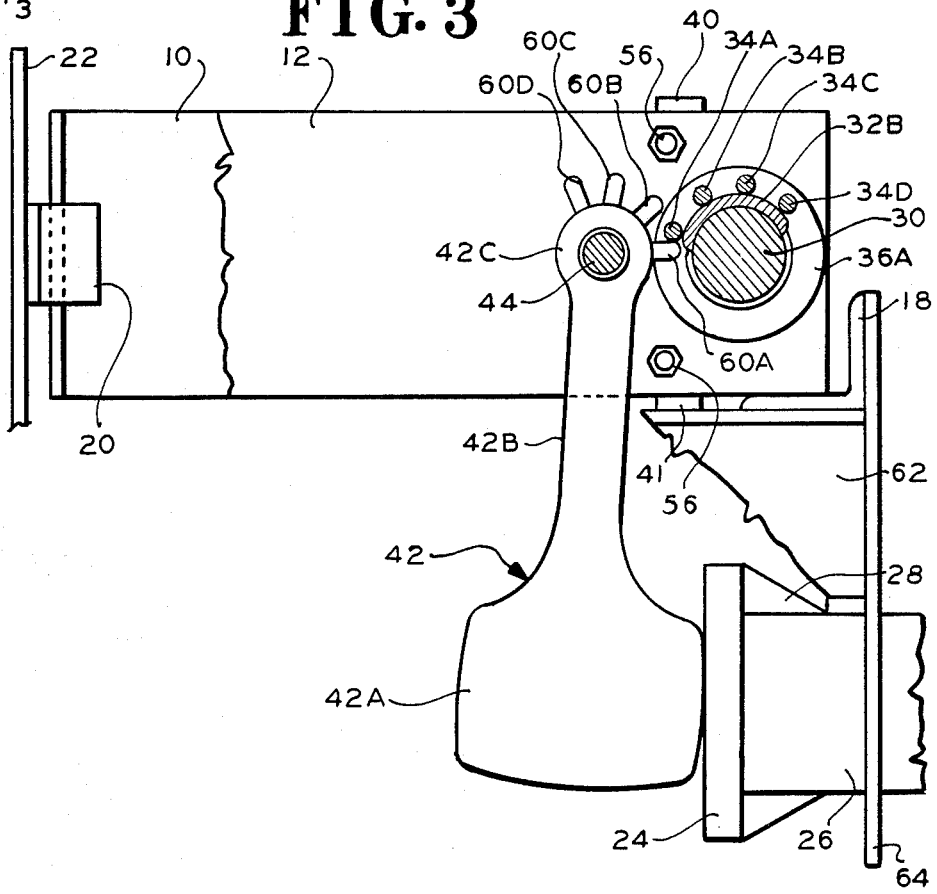
FIG. 3 is a side elevational view along lines 3—3 of FIG. 2.

Referring to FIGS. 3 and 4, hub 42C of hammer 42 is shown supporting a driven plurality of spaced teeth 60A, 60B, 60C and 60D, each in the shape of a round spoke with a rounded tip projecting in a radial direction. Teeth 60 are mounted into matching recesses in hub 42C by welding or by threading. In this embodiment, the angular spacing A1 between the first tooth 60A and second tooth 60B is equal to the angular spacing A2 between teeth 60B and 60C. The angular spacing A2 exceeds the angular spacing A3 between teeth 60C and 60D. Teeth 60A and 60B are equal in length while tooth 60C is longer than them by a predetermined amount, for example, 1/16th of an inch. The last tooth 60D is the longest and exceeds tooth 60C by a given amount (for example, 1/16 inch longer) to achieve the meshing and releasing described hereinafter. Hub 42C is positioned with respect to shaft 30 so that teeth 60A, 60B, 60C and 60D mesh with teeth 34 in a manner to be described presently.

As shown most clearly in FIG. 3, the previously mentioned angle iron 18 is supported athwart horizontal I beam 62. Beam 62 is cantilevered from member 22 and supports a series of inverted U-shaped guides, such as guide 64, which prevents sideway of member 26. Spanning bracket 41 is welded to the underside of beams 10 and 12.

Figure 5:
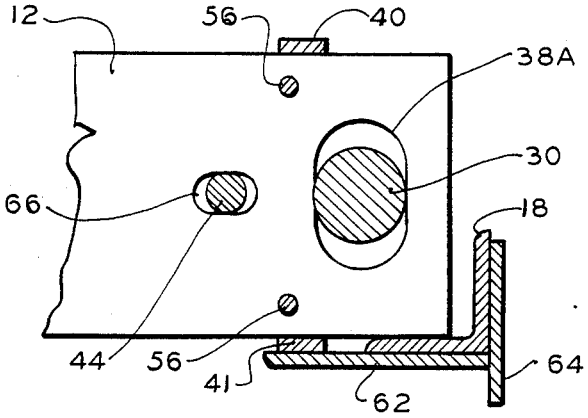
FIG. 5 is a sectional view along lines 5—5 of FIG. 2.

Referring to FIG. 5, this fragmentary, elevational view reveals the vertically elongate aperture 38A on beam 12. Also, slot 66 is illustrated on beam 12 (it being appreciated that there is a corresponding slot on beam 10). Slot 66 has its length perpendicular to the length of aperture 38A. Slot 66 has a width sized to allow free rotation therein of shaft 44 which supports the previously mentioned hammer (hammer 42 of FIG. 1).

Figure 7:
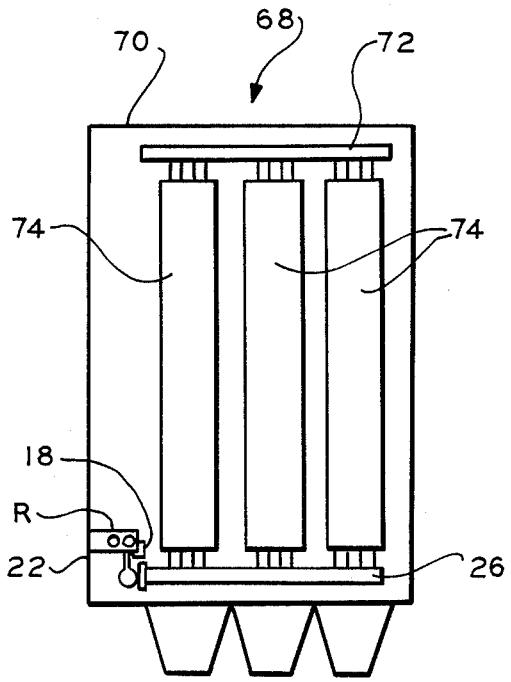
FIG. 7 is schematic, sectional view of a precipitator employing the rapper of FIG. 1.

FIG. 7 shows a precipitator 68 having an enclosure 70 in which are mounted an upper support beam 72 and lower support beam 26, previously illustrated. Suspended between beams 26 and 72 are three rows of collector plates 74, each row comprising a plurality of plates, for example, 30 plates. Rapper R (as shown in FIG. 1) is mounted as described before between wall 22 and cross beam 18. When operating, rapper R strikes beam 26.

To facilitate an understanding of the principles associated with the foregoing apparatus, its operation will be briefly described. Initially, the apparatus may be installed as illustrated in FIG. 1. Shaft 30 can extend considerably to power rappers identical to that of FIG. 1. Furthermore, the phase angle between the other sprockets on shaft 30 can all be different to provide a staggered rapping sequence. The apparatus is set initially by loosening bolts 56 and adjusting bearing plates 46A and 46B to produce the meshing between teeth 60A, 60B, 60C and 60D and 34A, 34B, 34C and 34D as illustrated in FIG. 3.

Figure 6A:
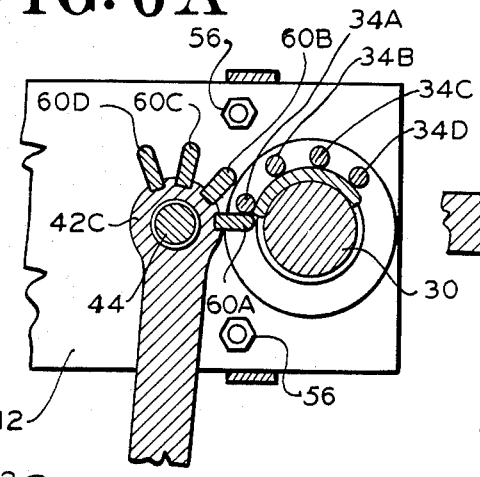
FIGS. 6A, 6B, 6C, and 6D are central, vertical, sectional views of the rapper of FIG. 1 showing its hammer in a down, intermediate, peak and released position, respectively.
Figure 6B:
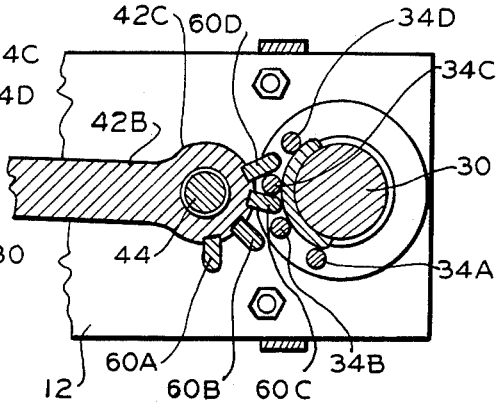

Starting with FIG. 6A, shaft 30 may rotate counterclockwise so that tooth 34A drives spoke 60A downward to rotate hub 42C clockwise. As shown in FIG. 6B, this clockwise rotation of hub 42C brings shank 42B into an approximately horizontal position as teeth 34A, 34B, 34C and 34D successively engage and downwardly thrust spokes 60A, 60B, 60C and 60D, respectively.

Although spoke 60D is somewhat longer than spoke 60C, the relatively small angle A3 (FIGS. 4 and 6B) avoids binding due to interference between elements 34D and 60D. Therefore, the tip of spoke 60D is smoothly inserted into the space between teeth 34C and 34D.

Figure 6C:
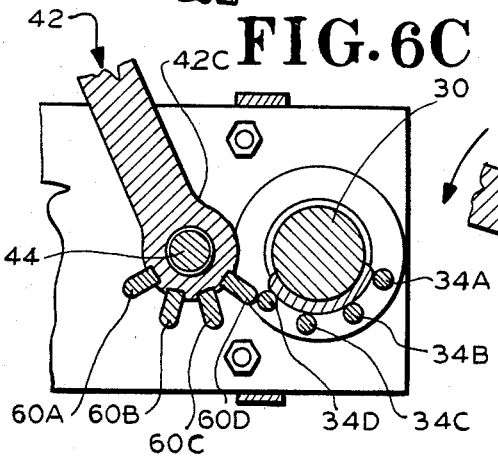
Figure 6D:
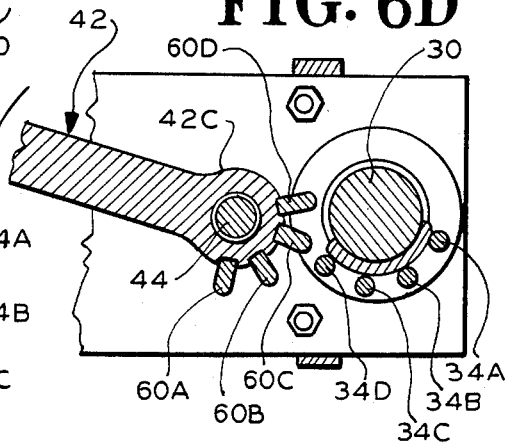

Continued rotation of shaft 30 eventually places the apparatus in the condition indicated in FIG. 6C, at which point hammer 42 is being released. As tooth 34D reaches the outermost point of the tip of spoke 60D, there is no longer any restraint on hammer 42. Significantly, since spoke 60D is longer than the other spokes, the other spokes cannot engage tooth 34D as hammer 42 falls, as shown in FIGS. 6C and 6D. The free fall of hammer 42 terminates with its striking plate 24 (FIG. 1) which completes a cycle of operation.

Since shaft 30 rotates within vertical slots 38A and 38B (FIGS. 1 and 5), the shaft is free to move vertically, to some limited extent. Also, since apertures 38A and 38B can move horizontally as frames 10 and 12 slide, shaft 30 can also move horizontally. Therefore, in the event shaft 30 is bent it can wobble within the rapper. It is important to notice that the horizontal spacing between the center line of shafts 44 and 30 does not change even though shaft 30 may wobble. The only relative motion by shaft 30 with respect to shaft 44 is a limited amount of vertical reciprocation within apertures 38A and 38B, too small to affect significantly the angle to which hammer 42 is driven.

Also significant is the fact that the above meshing takes place with a relatively open structure. For example, there is clearance between the circumference of teeth 34A, 34B, 34C and 34D and shaft 30 so that any precipitate or ash reaching that vicinity will not become compacted and will tend to be dislodged by the meshing. Furthermore, using rounded spokes 60A, 60B, 60C and 60D and rounded axial teeth 34A, 34B, 34C and 34D avoids creating other surfaces into which ash or precipitate can be compacted and cause jamming.

It is to be appreciated that various modifications may be implemented with respect to the above described preferred embodiment. While it is preferred that the foregoing components be constructed of a metal capable of withstanding the high heat and stress within a precipitator, other durable ceramics, plastics or other materials may be used instead. Also, while the various teeth are shown herein as rounded rods having perhaps blunted tips, in other embodiments stock having a square, triangular or other cross section can be used instead. Additionally, the number of teeth, both driven and driving, can be different than four. Furthermore, in some embodiments where the operator wishes to reduce the impact of the hammer, the last spoke on the hammer hub can be removed to release it earlier. While it is normally expected that the reciprocation of the hammer will be at a relatively low rate, such as once per minute, in embodiments having different needs, this speed can be altered. Also, the size, shape and length of the hammer can be altered depending upon the required impact. Additionally, the various sizes, dimensions and shapes disclosed herein can be altered to satisfy the required energy level, speed of operation, size limitations, temperature stability, tolerances, etc.

Obviously, many modifications and variations of the present invention are possible in light of the above teachings. It is, therefore, to be understood that within the scope of the appended claims, the invention may be practiced otherwise than as specifically described.

What is claimed is:

1. A rapper for striking a target in a precipitator, comprising:

a frame;

a hammer having a hub pivotally attached to said frame; and a drive sprocket means rotatably mounted in said frame and having a driving plurality of spaced teeth, said driving plurality of teeth comprising a plurality of peripherally spaced rods, each having clearance along at least a portion of its radially inward side, said driving plurality of teeth being distributed on said sprocket means along a given peripheral sector, the given peripheral sector being less than the entire periphery of said sprocket means;

a driven plurality of spaced teeth mounted on and radially extending from said hub, said driven plurality of spaced teeth being distributed along a fraction of the circumference of said hub and being sized to be engaged by said drive sprocket means and mesh with the driving plurality of teeth on said sprocket means, said rods of said sprocket means being arranged to mesh with said driven plurality of teeth transversely, all of said teeth of said sprocket means being distributed to mesh with an equivalent number of the teeth of said hub and then release said hub, more than one of said teeth of said sprocket means meshing with said hub for each release of said hammer.

2. A rapper according to claim 1 wherein said driving plurality of teeth comprise:

a pair of circumferential ridges atop said sprocket means; and said rods mounted across said pair of ridges.

3. A rapper according to claim 1 wherein each of said driven plurality of teeth comprise:

a round spoke having a rounded tip.

4. A rapper according to claim 3 wherein said driven plurality of teeth are arranged in an ordered sequence starting with a first and ending with a last and longest one.

5. A rapper according to claim 4 wherein said driven plurality of teeth having separations defined as the angle formed by lines radiating perpendicularly from the axis of rotation of said hub and through the centerline of each of said driven plurality of teeth, and wherein said driven plurality of teeth has between said last one and a tooth preceding said last one at inter-tooth angular separation that is smaller than the inter-tooth angular separation disposed between any other two adjacent teeth.

6. A rapper according to claim 1 wherein said frame is mounted to allow reciprocation in a given direction, said sprocket means being journalled in said frame to allow the axis of rotation of said sprocket means to reciprocate in a direction transverse to said given direction.

7. A rapper according to claim 6 wherein said frame includes a pair of parallel beams each having an elongate aperture into which said sprocket means is journalled.

8. A rapper according to claim 7 wherein each of said beams has a slot having a longitudinal axis, said longitudinal axis pointing in a direction toward said sprocket means, each of said beams comprising:

a bearing means releasably secured to said frame for sliding when released in a direction parallel to said longitudinal axis, said hub being journalled on said bearing means with its axis of rotation through said slot.

9. A rapper for striking a target in a precipitator, comprising:

a frame;

a hammer having a hub pivotally attached to said frame; and a drive sprocket means rotatably mounted in said frame and having a driving plurality of spaced teeth, said driving plurality of spaced teeth comprising a pair of circumferential ridges atop said sprocket means and a plurality of peripherally spaced, axially disposed rods mounted across said ridges, said driving plurality of spaced teeth being distributed on said sprocket means along a given peripheral sector, the given peripheral sector being less than the entire periphery of said sprocket means, all of said teeth of said sprocket means being distributed to mesh with an equivalent number of teeth on said hub and then release said hub, more than one of said teeth of said sprocket means meshing with said teeth on said hub for each release of said hammer.

* * * * *